US005901681A

United States Patent [19]

Mueller

[11] Patent Number: 5,901,681

[45] Date of Patent: May 11, 1999

[54] AIR FILTER

[75] Inventor: Heinz Mueller, Remseck, Germany

[73] Assignee: Filterwerk Mann & Hummel GmbH, Ludwigsburg, Germany

[21] Appl. No.: 09/000,453

[22] PCT Filed: May 15, 1996

[86] PCT No.: PCT/EP96/02087

§ 371 Date: Jan. 28, 1998

§ 102(e) Date: Jan. 28, 1998

[87] PCT Pub. No.: WO97/04853

PCT Pub. Date: Feb. 13, 1997

[30] Foreign Application Priority Data

Jul. 28, 1995 [DE] Germany ..... 295 12 201

[51] Int. Cl.[6] ..... F02B 77/00

[52] U.S. Cl. ..... 123/198 E; 55/385.3

[58] Field of Search ..... 123/198 E; 55/385.3, 55/DIG. 28

[56] References Cited

U.S. PATENT DOCUMENTS 4,799,470 1/1989 Honda et al. ..... 123/198 E

*Primary Examiner*—Noah P. Kamen

*Attorney, Agent, or Firm*—Evenson, McKeown, Edwards & Lenahan, P.L.L.C.

[57] ABSTRACT

An air filter for internal combustion engines having a filter housing, an air filter element fitted in the filter housing, a connector to secure the air filter to the internal combustion engine and an elastic connecting element between the air filter and an intake duct, in which the connecting element (18) is an elastic connecting element having an essentially hollow-cylindrical shape, and there are recesses (23, 24, 25) around the outer periphery and a flange (17) of the air filter extends into one of the circumferential recesses (23).

4 Claims, 3 Drawing Sheets

AIR FILTER

BACKGROUND OF THE INVENTION

The invention relates to an air filter. An air filter for internal-combustion engines, compressors and other air-intake machines is known from German Utility Model DE-GM 19 60 531. The filter housing of this air filter is flexibly connected to a clean-air duct and optionally also to an unfiltered-air inlet duct, the filter housing carrying two fork-shaped spring clips which are fixedly arranged at a distance from one another. These spring clips may engage in rubber parts which are arranged on the engine housing or on other vehicle parts and therefore fix the air filter housing.

A disadvantage of this arrangement is the fact that this connecting method does not offer sufficient safety in the case of internal-combustion engines in vehicles. Fairly extensive jolts or shocks should be expected particularly in cross-country vehicles which may have the result that the spring clips spring out of the rubber parts. In this case, the air filter would then only be held by the connecting lines.

Furthermore, an intake air filter is known from German Utility Model DE-GM 18 07 288 which is combined with a noise damper. The filter housing is provided with a mount which consists exclusively of elastic preforms. Recesses are provided in the filter housing wall as well as in the mount supports. The elastic preforms are locked into these recesses.

Also in the case of this arrangement, there is the disadvantage that particularly strong jolts of shocks may rip the filter housing out of its anchoring and cause damage to the engine.

SUMMARY OF THE INVENTION

It is the object of the invention to provide an air filter which can be arranged elastically and reliably on a mounting flange and has a simple design.

This object is achieved by providing an air filter and intake duct for internal-combustion engines comprising a filter housing, an air filter insert arranged in the filter housing, and a connecting element between the air filter and the intake duct for attaching the air filter to the internal-combustion engine, wherein the connecting element is an elastic connecting element which has an essentially hollow-cylindrical shape; recesses are provided extending around the outer circumference of the connecting element, and a flange of the air filter extends into one of the circumferential recesses.

An important advantage of the invention is the fact that the elastic connecting element simultaneously assumes two functions. On the one hand, it decouples the vibrations which emanate from the internal-combustion engine and, on the other hand, it serves to reliably fasten the complete air filter housing and a seal on the clean-air-side. For this purpose, the elastic connecting element, which has an essentially hollow-cylindrical shape, is provided with circumferential recesses, whereby a flange of the air filter projects into at least one of the recesses. As a result of the recesses, the elasticity of the connecting element can be adjusted in a precise manner so that the connecting element can be provided with optimal damping properties.

According to one embodiment of the invention, the additional circumferential recesses are provided with a greater radial depth. This serves to improve the decoupling and achieves damping even in the case of very high vibration amplitudes.

According to a further embodiment, the attachment of the connecting element can be carried out by a snap connection.

As an alternative, it is also possible to secure the connecting element with a screw flange. While the snap connection particularly simplifies the assembly, the connection via the screw flange has the advantage that a removal of the air filter is possible only by using appropriate tools.

These and other features of preferred embodiments of the invention, in addition to being described in the claims, are also indicated in the specification and the drawings, whereby the individual features may each be implemented alone or as a group in the form of subcombinations in the embodiments of the invention and in other fields and may represent advantageous, as well as separately protectable, embodiments for which protection is claimed here:

In the following the invention will be explained in detail with reference to an embodiment.

DETAILED DESCRIPTION OF PREFERRED EMBODIMENTS

Figure 1:
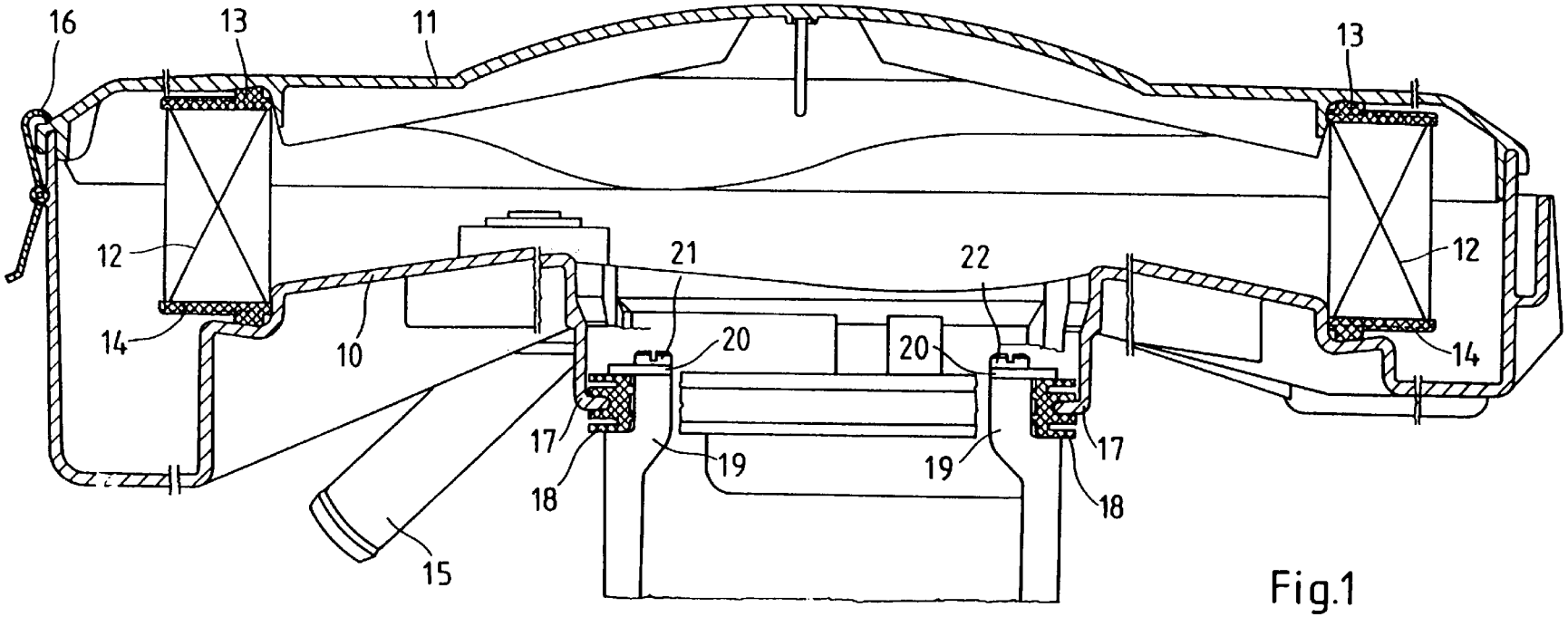
FIG. 1 shows a sectional view of an air filter.

The air filter according to FIG. 1 comprises a housing bottom part 10, a cover 11 as well as an air filter insert 12 clamped between the housing bottom part 10 and the cover 11. This air filter insert comprises, for example, a filter paper folded in a zigzag shape and, on its axial faces, has foamed-on end disks 13, 14. An unfiltered-air inlet 15 is arranged on the housing bottom part 10. The cover is fastened to the housing bottom part with clamping fasteners 16.

In its connection area, the housing bottom part 10 has a flange 17. This flange 17 extends into the central groove or the central recess of an elastic connecting element 18. The elastic connecting element 18 is fitted onto an annular shoulder on an inlet opening of an intake manifold 19 and is held by an attachment flange 20. The attachment flange 20 is fixed by screws 21, 22.

Instead of the arrangement of a fastening flange 20, the clean-air connection piece 19 may also be provided with detent elements. These detent elements are, for example, scale-like construction of the contact area of the connecting element 18, with the receiving area of the clean-air connection piece.

Figure 2:
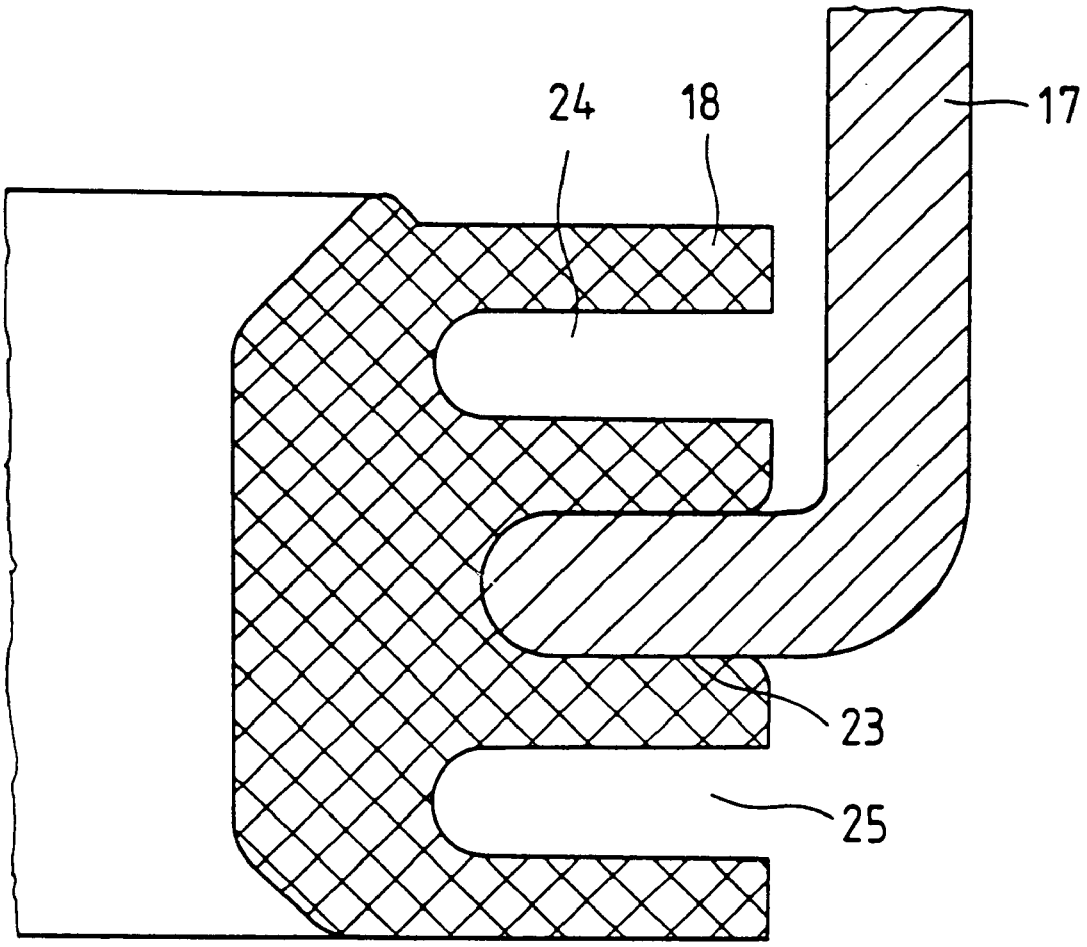
FIG. 2 shows the design of the elastic connecting element.
Figure 3:
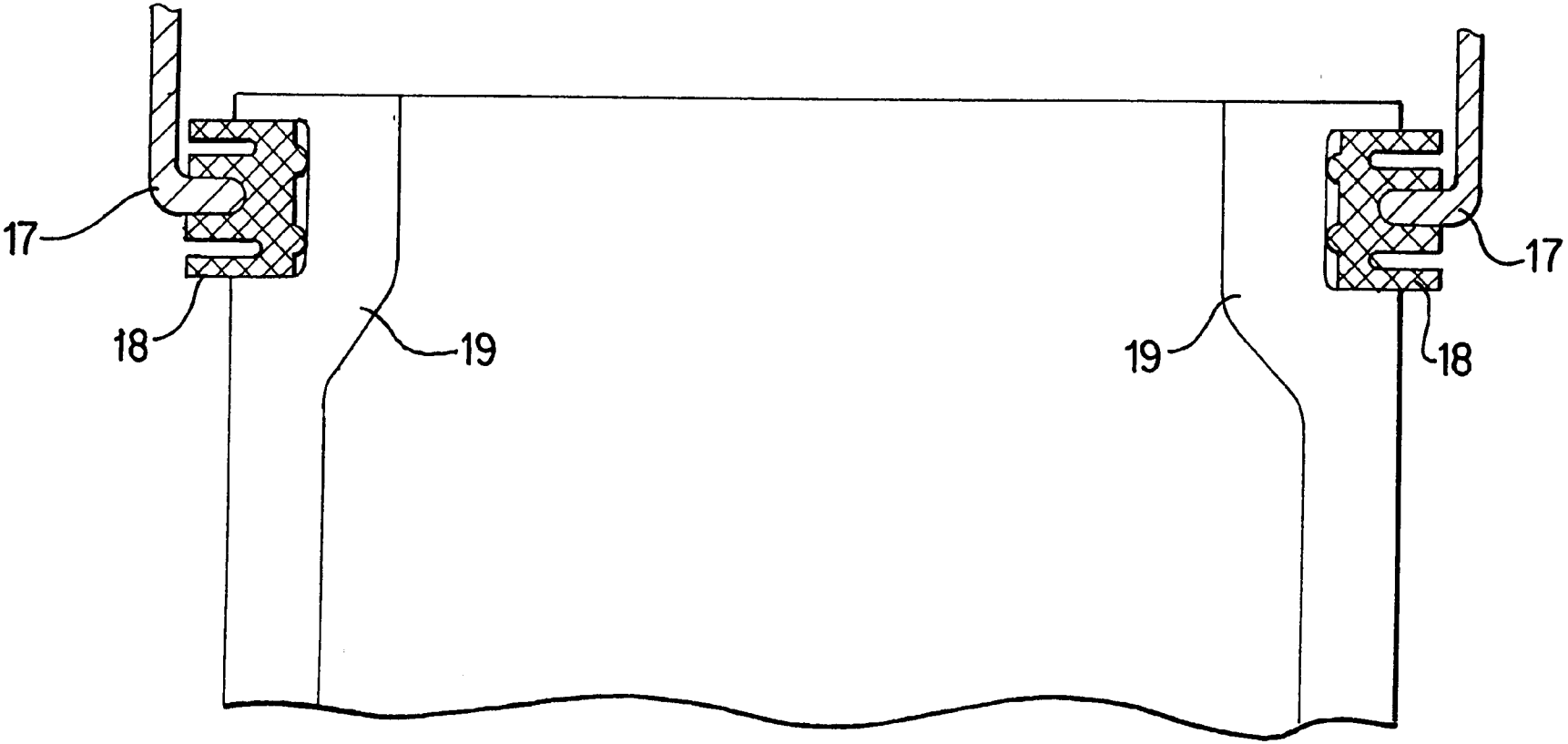
FIG. 3 shows an alternate embodiment in which the elastic connecting element is snapped into a recess on the intake duct.

FIG. 2 is an enlarged representation of the connecting element. The central circumferential recess 23 is shown here in which the flange 17 is arranged. The two outer recesses 24, 25 have a greater depth. This has the result that the central area of the connecting element achieves better elastic properties. By varying the depth of the recesses 24, 25, the elastic properties of the connecting element can be changed. Naturally, it is also possible to provide additional recesses, for example, also of a smaller width. The connecting element is therefore suitable for effectively damping vibrations which are generated by the internal-combustion engine.

I claim:

1. In combination, an air filter and an air intake duct for an internal-combustion engine, said air filter comprising a filter housing and a filter insert arranged in the filter housing, and a connecting element for attaching the air filter to the intake duct of the internal-combustion engine, wherein said connecting element is an elastic connecting element interposed between the air filter and the intake duct; said connecting element having an hollow-cylindrical shape with a plurality of circumferential recesses extending around the outer periphery of the connecting element, and a flange of the air filter being received in one of the circumferential recesses.

2. An air filter according to claim 1, wherein the circumferential recesses which do not receive the flange of the air filter, have a greater radial depth than the recess which receives the flange.

3. An air filter according to claim 1, wherein the elastic connecting element is snapped into a recess on the intake duct.

4. An air filter according to claim 1, wherein the elastic connecting element is disposed in a annular sholder on the intake duct and secured therein by a screw flange.

* * * * *